US008256227B2

(12) United States Patent
Devine

(10) Patent No.: US 8,256,227 B2
(45) Date of Patent: Sep. 4, 2012

(54) ULTRA EFFICIENT ENGINE

(76) Inventor: John Arthur Devine, Chesterfield, MO (US)

( * ) Notice: Subject to any disclaimer, the term of this patent is extended or adjusted under 35 U.S.C. 154(b) by 941 days.

(21) Appl. No.: 12/198,224

(22) Filed: Aug. 26, 2008

(65) Prior Publication Data

US 2009/0056667 A1 Mar. 5, 2009

Related U.S. Application Data

(60) Provisional application No. 60/968,434, filed on Aug. 28, 2007, provisional application No. 60/974,707, filed on Sep. 24, 2007, provisional application No. 61/015,059, filed on Dec. 19, 2007, provisional application No. 61/020,302, filed on Jan. 10, 2008, provisional application No. 61/047,230, filed on Apr. 23, 2008.

(51) Int. Cl.
*F01B 29/04* (2006.01)
*F15B 15/00* (2006.01)

(52) U.S. Cl. ..... 60/774; 60/712; 60/560; 123/70 R; 123/68; 123/197.4

(58) Field of Classification Search ..... 123/197.1, 123/197.4, 70 R, 68
See application file for complete search history.

(56) References Cited

U.S. PATENT DOCUMENTS

| | | | |
|---|---|---|---|
| 125,166 | A | 4/1872 | Brayton |
| 1,773,995 | A | 8/1930 | Goldsborough |
| 3,071,123 | A | 1/1963 | Gromme |
| 3,870,116 | A | 3/1975 | Seliber |
| 3,981,279 | A | 9/1976 | Bubniak et al. |
| 4,159,700 | A | 7/1979 | McCrum |
| 4,214,447 | A | 7/1980 | Barton |
| 4,437,437 | A | 3/1984 | Erickson |
| 4,449,488 | A | 5/1984 | Heaton |
| 4,492,188 | A | 1/1985 | Palmer |
| 4,599,863 | A | 7/1986 | Marttila |
| 4,783,966 | A | 11/1988 | Aldrich |

(Continued)

FOREIGN PATENT DOCUMENTS

WO 2009032632 3/2009

OTHER PUBLICATIONS

Star Rotor Corporation, "Engines", website: http://www.starrotor.com/engines, Aug. 28, 2010.

(Continued)

*Primary Examiner* — Noah Kamen
*Assistant Examiner* — Grant Moubry
(74) *Attorney, Agent, or Firm* — Thompson Coburn LLP

(57) ABSTRACT

An engine comprises a combustion chamber, an expansion cylinder with a piston adapted for reciprocating motion in the expansion cylinder via combustion products combusted in the combustion chamber, and a transmission associated with the expansion cylinder. The transmission has a guide frame with a first drive wheel rotatably mounted at one end of the guide frame and a second drive wheel rotatably mounted at an opposite longitudinal end of the guide frame. Each of the drive wheels is driven by an inextensible continuous loop. The guide frame has a crank head adapted to reciprocatingly translate along the guide frame. The crank head has a drive connection pivotally connecting the crank head to the loop. The crank head is operatively connected to the piston such that reciprocating motion of the piston results in corresponding reciprocating motion of the crank head, movement of the loop, and corresponding rotation of the drive wheels.

17 Claims, 9 Drawing Sheets

U.S. PATENT DOCUMENTS

| | | | | |
|---|---|---|---|---|
| 4,917,054 | A | 4/1990 | Schmitz | |
| 5,056,471 | A | 10/1991 | Van Husen | |
| 5,427,580 | A | 6/1995 | Ledvina et al. | |
| 5,816,202 | A | 10/1998 | Montresor | |
| 5,823,769 | A | 10/1998 | Joshi et al. | |
| 5,934,076 | A | 8/1999 | Coney | |
| 6,032,635 | A | 3/2000 | Moorman et al. | |
| 6,092,365 | A | 7/2000 | Leidel | |
| 6,119,649 | A | 9/2000 | Raab | |
| 6,393,841 | B1 | 5/2002 | Van Husen | |
| 6,467,440 | B1 | 10/2002 | Kozulin | |
| 6,854,429 | B2 | 2/2005 | Gelfand | |
| 6,889,651 | B2 | 5/2005 | Tanaka et al. | |
| 6,904,888 | B1 * | 6/2005 | Heifets | 123/197.1 |
| 6,966,281 | B1 * | 11/2005 | Hale et al. | 123/46 SC |
| 6,981,483 | B1 * | 1/2006 | Keip | 123/197.1 |
| 7,201,133 | B2 * | 4/2007 | McKeown | 123/197.1 |
| 7,219,630 | B2 | 5/2007 | Patton | |
| 2005/0011487 | A1 | 1/2005 | Warren | |

OTHER PUBLICATIONS

Smithsonian National Museum of American History, "Selden Automobile Patent Model, 1879", website: http://americanhistory.si.edu/collections/object.cfm?key=35&objkey=9047, Aug. 28, 2010.

* cited by examiner

ULTRA EFFICIENT ENGINE

CROSS-REFERENCE TO RELATED APPLICATIONS

This application claims the benefit of provisional application Ser. No. 60/968,434, filed Aug. 28, 2007; provisional application Ser. No. 60/974,707, filed Sep. 24, 2007; provisional application Ser. No. 61/015,059, filed Dec. 19, 2007; provisional application Ser. No. 61/020,302, filed Jan. 10, 2008; and provisional application Ser. No. 61/047,230, filed Apr. 23, 2008, the disclosures of which are incorporated by reference herein.

BACKGROUND OF THE INVENTION

This invention relates generally to a heat engine.

BRIEF DESCRIPTION OF THE DRAWINGS

The accompanying drawings, which are incorporated in and form a part of the specification, illustrate, and together with the description serve to explain, the various embodiments disclosed herein. In the drawings.

DETAILED DESCRIPTION OF THE PREFERRED EMBODIMENT

Figure 1:
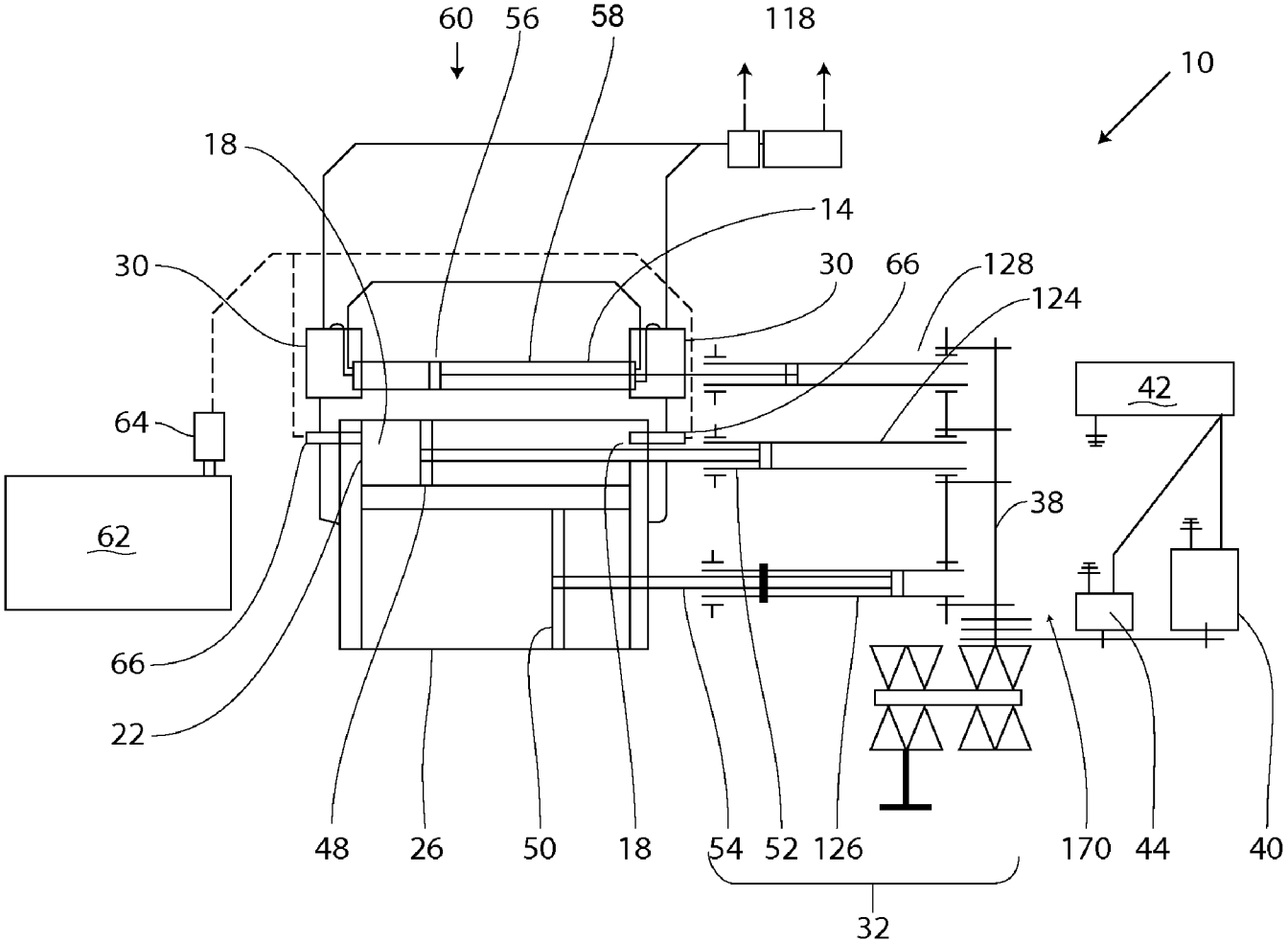
FIG. 1 illustrates one embodiment of the heat engine comprising an air compressor, stage #1 expansion cylinder with integral combustion chamber, and stage #2 expansion cylinder.
Figure 2:
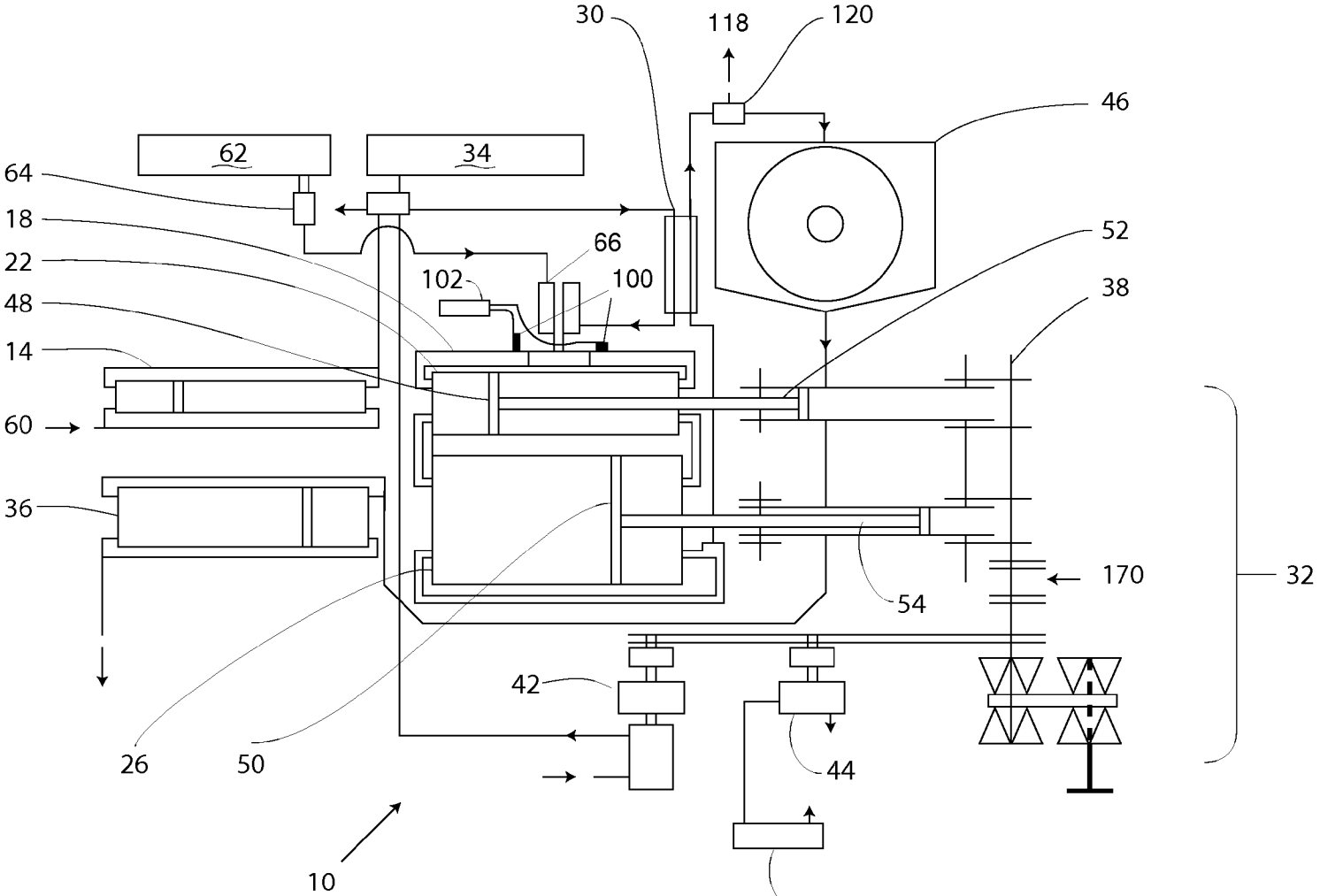
FIG. 2 illustrates an alternative embodiment of the heat engine comprising an air compressor, combustion chamber, stage #1 expansion cylinder, stage #2 expansion cylinder, radiator, and exhaust pump.

As shown in the FIGS. 1 and 2, the heat engine 10 is preferably comprised of a compressor 14, a combustion chamber 18, a stage #1 expansion cylinder 22, a stage #2 expansion cylinder 26, a regenerator 30, and a transmission system 32. FIG. 1 shows an embodiment of the heat engine wherein the combustion chamber 18 and stage #1 expansion 22 cylinder are integrally formed, and FIG. 2 shows an alternative embodiment wherein the combustion chamber 18 and stage #1 expansion cylinder 22 are separate. FIG. 2 shows an embodiment of the heat engine including a radiator to further cool combustion products. FIG. 2 also shows an embodiment of the heat engine including an oxidant storage tank 34 and an exhaust pump 36. The embodiment of the heat engine of FIG. 1 does not include these components. In the embodiment of the heat engines shown in FIGS. 1 and 2, the stage #1 and stage #2 expansion cylinders 22,26 are provided. Also, in the embodiment of the heat engines shown in FIGS. 1 and 2, the output of the stage #1 expansion cylinder 22 and the stage #2 expansion cylinder 26 drive the components of the engine, including a drive shaft 38, the air compressor 14, and exhaust pump 36 (FIG. 2). It should be appreciated that the heat engine may have fewer or more components, including any combination of the components shown in the drawings, and that any one or more of the auxiliary components of the heat engine may be driven by separately or indirectly (i.e., electric motor 40 from a battery 42 or alternator 44) from the output of the expansion cylinders.

The combustion process in each of the embodiments of the heat engine is similar: a compressor 14 compresses an oxidant (i.e., air) to be mixed with fuel, and then combusted continuously or semi-continuously in a combustion chamber to produce high pressure and temperature combustion products that may be expanded to drive a reciprocating piston and transmission. As described below in greater detail, the engine may be configured such that combustion occurs in the stage #1 expansion cylinder 22 wherein the length of time of combustion and/or intensity per stroke may vary depending on the limitations of the engine or engine power requirements. Alternatively, the engine may be configured such that combustion occurs in a combustion chamber 18 located away from the stage #1 expansion cylinder 22. In this configuration combustion may be continuous or semi-continuous and the intensity of combustion may vary. As an alternative, the engine may have a sub-atmospheric pressure exhaust condensing system (i.e., radiator 46 (FIG. 2) and exhaust pump (FIG. 2)), if desired when the water vapor content in the combustion products is sufficiently high and the temperature of the medium cooling the combustion products is sufficiently low. The vapor in the exhaust combustion products may condense causing the combustion products to fall in pressure to below atmospheric pressure, thereby reducing the back pressure on the stage #2 expansion cylinder 26 and thereby effectively increasing power output.

Figure 3:
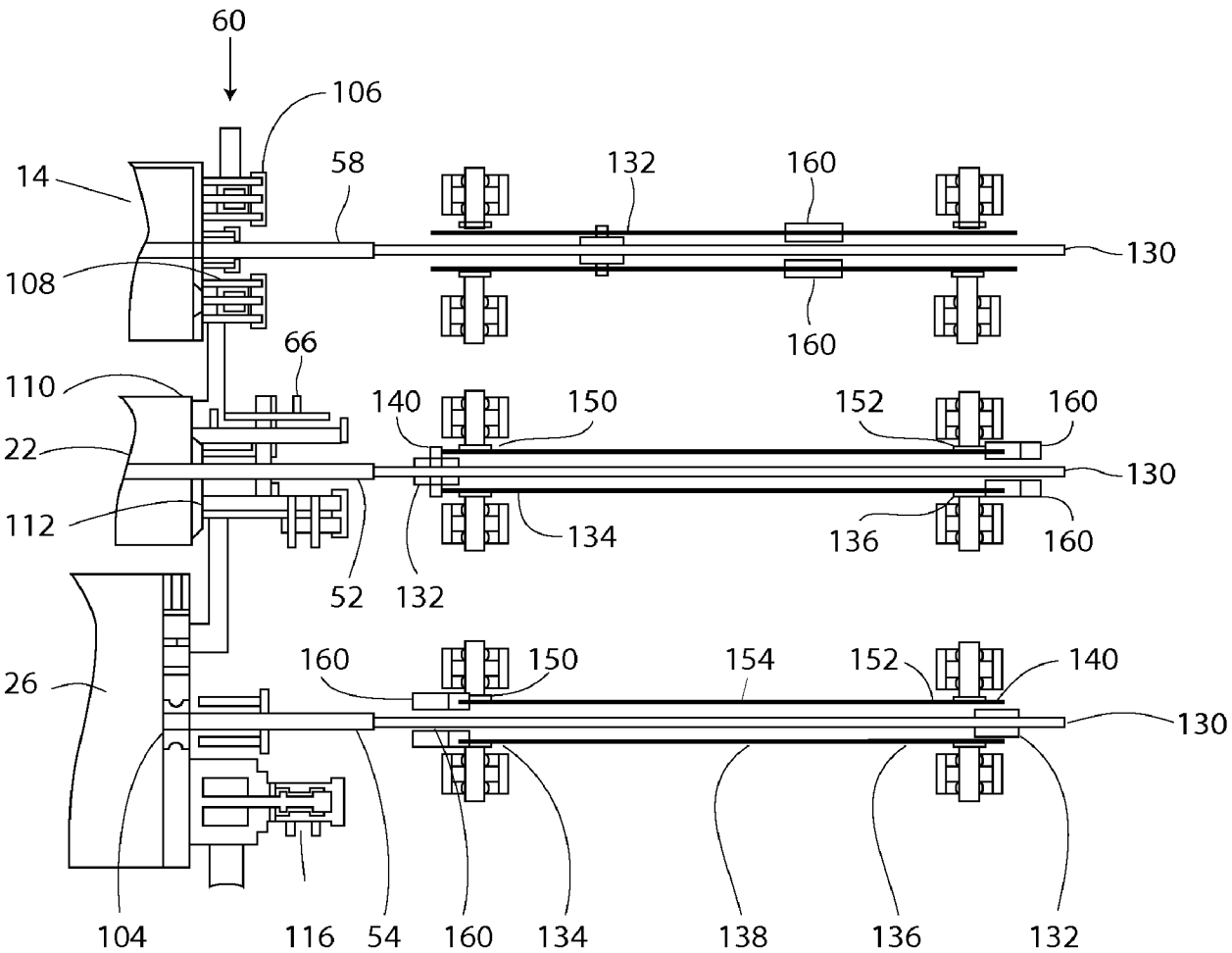
FIG. 3 illustrates a transmission assembly that may be used in the heat engine, for instance, the embodiment of FIG. 1, wherein the air compressor, stage #1 expansion cylinder and stage #2 expansion cylinder have transmissions that are operatively coupled together to drive a drive shaft.

In each of the embodiments of the heat engine shown in the figures, each of the expansion cylinders 22,26 has a piston 48,50 with a connecting rod 52,54 that travels in a relatively long linear motion path. The pistons may be dual acting pistons, thus allowing simultaneous opposite cycles. The pistons may also be sequenced to reciprocate opposite each other harmoniously. The long, linear reciprocating motion path of each piston is transmitted to the transmission 32 comprising a guide frame and loop drive assembly as shown in FIG. 3. The engine and transmission may also be balanced to reduce vibrations translating to the engine platform such as a vehicle or machine. A description of each of the individual components of the engine, along with alternative components and constructions therefor follows below.

Air Compressor

FIGS. 1 and 2 show an embodiment of the engine where an oxidant source for mixing with fuel to form a combustible mixture for combustion comprises the air compressor 14. While a source of compressed air is preferable for combustion, it should be appreciated that a source of any oxidant, whether compressed or uncompressed may be used in accordance with the principles of the invention. The compressor 14 may be comprised of dual opposing pistons, dual pistons with a conventional crank shaft, or rotary screw type compressor. For instance, the compressor may have a single or dual acting piston 56 operatively connected via a shaft to be driven by the output of the engine. When configured as an air compressor, an intake 60 for the compressor 14 may be aligned to atmosphere. The compressor piston strokes may be phased as desired with the engine. For instance, the phasing may be such that the compressor piston discharges oxidant into the regenerator 30 as the compressor piston 56 is approaching the end of its compression stroke while at the same time the stage #1 expansion cylinder piston reverses direction and begins its expansion stroke. The compressor may have valves that are opened against spring pressure by the incoming or outgoing oxidant from the compressor discharge and/or intake and closed or seated by operating pressure. As an alternate, the compressor may be powered via a variable ratio transmission system operatively connected to the drive output of the engine. The compressor system may be placed on-line via an electric powered actuator clutch. With the clutch, the compressor may be mechanically disconnected from the engine at start up to reduce initial power requirements. An electric motor may be used to power the compressor during start-up. A ratchet clutch may also be used, so once the electric motor turns the compressor at a higher rpm than the engine the engine would not be loaded during start-up. The compressor may also turn at a different rpm than the main engine drive assembly and be operatively connected to the main engine drive assembly via reduction gears. The oxidant tank 34 may be incorporated in the discharge of the compressor 14 to reduce pulsations and to provide a reservoir of compressed oxidant. As an alternative, the compressor may have a primary and secondary compressor—one powered directly from the engine and the other from an electric motor. As another alternative, oxidant may be compressed through a separate compressor not associated with the engine and stored in a compressed state in a tank (compressed oxygen or air) thereby dispensing with the need for an air compressor. The pressurized oxidant stored in a tank may also be used to power a motor or generator as it is expanded to the required pressure for introduction to the combustion chamber.

Regenerator

As shown in the drawings, the oxidant (i.e., compressed air) is preferably directed to a regenerator(s) 30 which preheats the oxidant with combustion products discharged from the stage #2 expansion cylinder 26. In a dual acting piston arrangement shown in FIG. 1, two regenerators 30 may be provided, and the discharge of each side of the stage #2 expansion 26 cylinder may communicate with a respective regenerator. In FIG. 2, one regenerator 30 is used to preheat the oxidant before introduction into the combustion chamber 18. Preferably, the regenerator has a first chamber in communication with the oxidant source and a second chamber in communication with the expansion cylinder, and the first and second chambers are arranged in such a way that any heat associated the combustion products exhausted from expansion cylinder is transferred to the oxidant before the oxidant enters the combustion chamber. For instance, the regenerator may comprise an outer insulated housing with a large number of small thin wall tubes, and combustion products would pass through the tubes with the compressed air traveling in an opposing direction through a number of baffles over the outside of the tubes. In such an arrangement, the space between the tubes may be minimized. The heat transferred to the oxidant (i.e., compressed air) by the combustion products expands the oxidant in the regenerator allowing additional heat absorption before the oxidant is introduced into the combustion chamber. In addition to a regenerator(s) for the compressed oxidant, fuel from a fuel source may pass through the same regenerator or a separate regenerator prior to its introduction into the combustion chamber. While the regenerator provides certain advantages in enhancing the efficiency of the engine, it should be appreciated that the engine may not be provided with a regenerator.

Connecting Pipes/Ports System

Pipes or ports are provided between the combustion chamber, expansion cylinders and other various components of the engine. The pipes or ports preferably have a size and shape that reduces flow restrictions and heat loss. The pipes and ports are constructed from a suitable material to withstand heat, pressure, and loads, and may be insulated as necessary to reduce heat loss. In addition, to conventional insulation and lagging used for high temperature systems, a housing of the engine, in which high temperature components such as the cylinders and chambers are situated, may comprise a containment shell allowing a vacuum to be drawn in the housing to reduce heat loss and increase efficiency of the engine.

Fuel Pump and Regulator

The engine may be provided with a fuel source 62, fuel pump 64, and/or a regulator (not shown) to maintain the pressure of the fuel at a level sufficient to maintain proper combustion. The pump may comprise a rotary pump driven by a motor. If the pressure of the stored fuel is greater than the pressure of the fuel when injected into the combustion chamber, the differential pressure across the pump will be reversed from that of normal operation and the motor of the rotary pump may be configured to act as a generator to generate electricity and enhance engine efficiency. As an alternative, the fuel pump may be a piston pump and may be a dual acting piston pump. The fuel pump may be operatively connected to and timed with the air compressor so that a mixture of fuel and air can be consistently delivered to the combustion chamber in a set ratio. The fuel regulator may also be actuated via a pilot pressure from the oxidant source (i.e., air compressor discharge) so that a set ratio of fuel and oxidant may be consistently delivered to the combustion chamber. The fuel pump may also be electrically controlled allowing output pressure to be regulated independently. As mentioned previously, the fuel discharged from the fuel pump may be passed through a regenerator.

Fuel Ignition Assembly

The intake valves of the combustion chamber are preferably aligned in communication with the oxidant source, for instance, the discharge of the air compressor or air receiver tank, to introduce oxidant into the combustion chamber for mixing with the fuel to form a combustible mixture to be combusted in the combustion chamber. Fuel valves of the combustion chamber are aligned in communication with the fuel source to mix with the oxidant to form a combustible mixture to be injected into and combusted in the combustion chamber. The oxidant is preferably stored at a sufficiently high pressure so that the oxidant may introduced into the combustion chamber at a velocity sufficient to mix with the fuel to form the combustible mixture. The fuel and oxidant valves are sequenced to atomize the correct amount of fuel and oxidant to form the combustible mixture for injection and combustion in either a central combustion chamber, a mixing chamber or a combustion area of an expansion cylinder.

Figure 4:
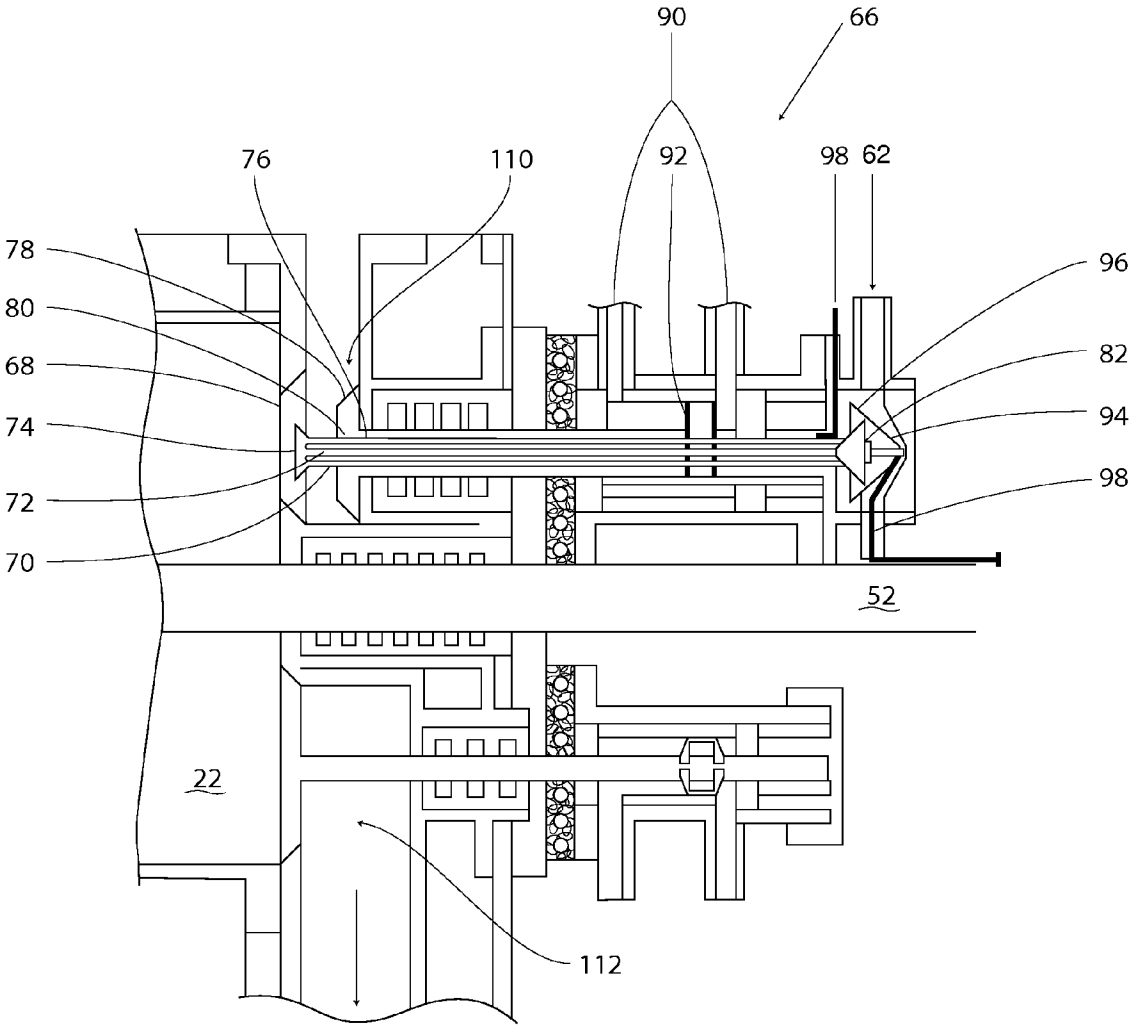
FIG. 4 illustrates a fuel ignition assembly that may be mounted to the stage #1 expansion cylinder and integral combustion chamber of the heat engine.

FIG. 4 shows one embodiment of a fuel ignition assembly 66 where the combustion chamber intake valves and fuel ignition assembly are integrated and mounted adjacent a combustion area of the stage #1 expansion cylinder, for instance, in the embodiment of the heat engine shown in FIG. 1. Preferably, the ignition assembly 66 is a mounted adjacent an intake port 68 of the combustion chamber/stage #1 expansion cylinder in a way that the ignition assembly is insulated from intense heat of combustion, but ensures that the fuel and oxidant are sufficiently mixed prior to injection into the combustion chamber. For instance, when the ignition assembly is configured to ignite the combustible mixture, the combustion flame is directed into the combustion chamber and away from the ignition assembly.

In the embodiment shown in FIG. 4, the fuel ignition assembly 66 has an inner valve sleeve 70 comprising a tubular member with an interior communicating with the fuel source 62 to deliver fuel to the combustion chamber/stage #1 expansion cylinder. The inner valve sleeve 70 has an inner poppet comprising a valve stem 72 disposed in the inner valve sleeve interior and a valve body 74 connected to the stem. Preferably, the diameter of the inner valve sleeve 70 and valve stem 72 are sized to allow the fuel to freely flow around the stem in the inner valve sleeve to the tip for atomization and mixing with the oxidant flow. The inner valve body 74 is positionable relative to a distal end of the inner valve sleeve 70 to regulate the flow of fuel into the combustion chamber. Preferably, the inner valve sleeve 70 is fixed and the valve stem 72 is movable therein. The valve ignition assembly also has an outer valve sleeve 76 comprising a tubular member with an inner surface receiving the inner valve sleeve. The outer valve sleeve has outer and inner valve seats 78,80 on its distal end. The outer valve sleeve 76 is positionable between first and second positions. In the first position, the outer valve sleeve distal end is spaced from the inner valve sleeve 70 and the inner valve poppet valve body 74 to allow the oxidant and the fuel to flow into the combustion chamber. In the second position, the outer valve sleeve outer seat 80 forms a seal with the intake port 68 in the combustion chamber/stage #1 expansion cylinder to seal the combustion chamber from the oxidant source. In the second position, the outer valve sleeve inner seat 78 forms a seal with the inner valve poppet valve body 74 to seal the inner valve seal interior and stop the flow of fuel into the combustion chamber. A cut-off valve 82 may also be arranged on the proximal end of the inner poppet valve stem 72 as an additional valve to shut off the flow of fuel to the combustion chamber.

Figure 5:
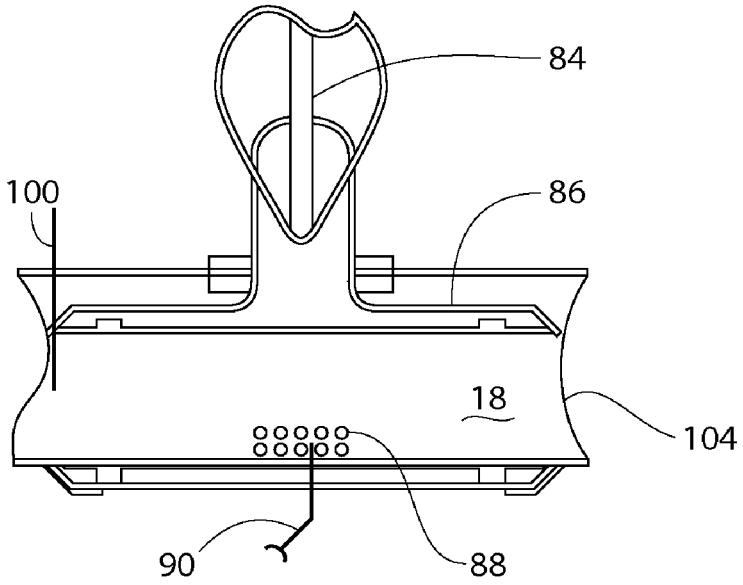
FIG. 5 illustrates an alternative embodiment of an injection assembly used in a combustion chamber separate from the stage #1 expansion cylinder, for instance, the combustion chamber of the heat engine shown in FIG. 2.

FIG. 5 shows an alternate embodiment of a fuel ignition assembly 66 wherein a valve 84 regulates the flow of oxidant (i.e., air) into a centrally located combustion chamber 18. The oxidant from the oxidant source preferably flows in a plenum 86 around the combustion chamber at a rate regulated by the oxidant regulator valve 84. The oxidant is then introduced into the combustion chamber 18 through perforations 88 in the combustion chamber wall to be then mixed with the fuel and combusted in the combustion chamber. Preferably, the fuel ignition assembly is configured to spray or atomize the fuel to enhance mixing with the oxidant before the combustible mixture is injected into the combustion chamber. A fuel injector port 90 may be embedded within the air perforations of the combustion chamber. Although one fuel injector port is shown, multiple may be provided. As an alternative, the fuel ignition assembly may comprise a tapered sleeve with a distal end positioned in the combustion chamber. A body of the fuel valve is preferably positionable relative to an inner sealing surface in the tapered sleeve to regulate the flow of fuel into the combustion chamber. For instance, the inner valve assembly of the fuel ignition assembly of FIG. 4 may be configured in this way. In such an arrangement, the inner valve sleeve may have an interior sealing surface on its distal end and the inner valve poppet may have a body that moves relative to the sealing surface within the interior of the valve sleeve. Thus, when the valve body retracts away from the distal end to toward the proximal end of the inner valve sleeve, fuel flows into the combustion chamber, and when the valve body moves toward the distal end of the inner valve sleeve, the body engages the sealing surface to stop the flow of fuel into the combustion chamber. Movement of the inner valve poppet may be effect via an electronic control system. As an alternative, the inner valve sleeve may be configured as a nozzle and an valve located external to the fuel ignition assembly may control the flow of fuel to the combustion chamber.

The valve actuation or regulator control in the ignition assembly may be hydraulically controlled or operated electronically by way of a servo motor. As shown in FIG. 4, hydraulic fluid ports 90 direct hydraulic fluid to an actuator 92 on the proximal end of the outer valve sleeve 76 to move the outer sleeve between the first and second positions. As mentioned previously, the inner valve sleeve 70 is preferably fixed in position and the inner poppet is maintained in position via spring fingers 94 located adjacent the proximal end of the inner valve stem 72. Thus, when the engine is operating, the spring fingers 94 bias the inner poppet valve stem 72 and valve body 74 apart from the inner valve sleeve 70 to allow fuel to be flow into the oxidant stream, and the interior valve cut-off valve 82 away from its seat 96 to allow fuel to flow from the source 62 into the inner valve sleeve interior. When engine operation is stopped, the outer valve sleeve moves to the second position and the outer valve sleeve inner seat 80 seals with the inner poppet valve body 74 to stop the flow of fuel into the combustion chamber. As mentioned before, when the outer valve sleeve moves to the second position, the outer valve sleeve outer seat 78 forms a seal with the combustion chamber intake port 68. In this motion, the inner poppet valve body and valve stem 72 are drawn together with the motion of the outer valve sleeve against the pressure of the spring fingers 94 to seal the cut-off valve 82 against its seat 96. The piston, the cylinder, and ports of the outer valve sleeve valve actuator 92 may be configured to reduce the actuation force of the hydraulic fluid during the piston stroke in the actuator cylinder to slow the movement of the outer valve sleeve and reduce impact with the sealing surfaces 68,78 of the intake. It should be appreciated that the valve actuation may also be computer controlled, for instance, comprising a servo-electric motor turning a screw drive to move the valves as necessary. The ignition assembly may be configured to switch between an automatic and manual modes depending upon the application in which the heat engine is used. The outer valve sleeve 76 may rotate on its axis during operation of the engine to reduce localized wear between the respective sealing surfaces and valve seats. For instance, the outer valve sleeve valve actuator 92 may have detents on the outer periphery of the actuator piston creating multiple surfaces on the actuator for hydraulic fluid to impinge to induce rotation of the valve sleeve 76. The valves may be arranged as control valves to finely control the flow of oxidant from the oxidant source and fuel from the fuel source to the combustion chamber. Preferably, the oxidant and fuel regulator valves are sequenced and phased to deliver the combustible mixture in the stoichiometric ratios needed for maximum combustion and engine power output. The oxidant (i.e., air) regulator valve may also be configured to bleed excess air as required to maintain a desired temperature for the combustion products, pistons, and cylinders. A regulator valve may also be used to control the flow of water vapor injection into the combustion chamber. Water vapor may be injected into the engine cycle to absorb heat and expand with the combustion products to be condensed later to add to the work output of the engine.

In the embodiment of the fuel ignition assembly shown in FIG. 4, the inner poppet valve stem 72 and inner valve sleeve 70 are preferably sufficiently electrically conductive to generate a spark to ignite the combustible mixture when the inner valve poppet body is spaced from the inner valve sleeve. The inner poppet valve stem 72 and inner valve sleeve 70 are preferably electrically connected a voltage source 98 so as to generate a spark for ignition when the inner poppet valve stem and inner valve sleeve are separated. It should be appreciated that applying voltage across the inner poppet valve stem and inner valve sleeve, as well as providing connections to ground, may be effected in other ways. As an alternative, where a central combustion chamber is provided as shown in FIGS. 2 and 5, spark plugs 100 connected to a high voltage source 102 would be activated each time the combustion process is to be initiated. This system may generate sparks until combustion is established and the temperature of the chamber is sufficiently elevated to sustain continuous combustion. A combustion sensor may be provided adjacent the intake ports to sense combustion and stop sparking when combustion is self-sustainable from latent heat or continuous combustion. The combustion sensor may also send signals to the regulators or valves to control the oxidant/fuel mixture by sensing the light color spectrum emitted by the combustion flames.

Combustion Chamber

The combustion chamber 18 combusts the combustible mixture to produce high temperature and high pressure combustion products for expansion in either the stage #1 or stage #2 expansion cylinders, depending upon the configuration of the heat engine. As mentioned previously, the combustion chamber 18 may also be configured integral with the stage #1 expansion cylinder 22. In such an arrangement, the combustion chamber intake valves are preferably normally open at the start of the stroke, and may be closed at any point along the stroke. It should be appreciated that the engine could run "wide open" in which case the intake pressure may fluctuate in each stroke. When the combustion chamber is configured to be integral with the stage #1 expansion cylinder, the combustion products insulate the piston, chamber walls and connecting rod from the heat of combustion. Arranging the combustion chamber to be integral with the stage #1 expansion cylinder allows the expanding gases to directly drive the piston thereby reducing inefficiencies and losses associated with piping, ports, and valves. By configuring the combustion chamber to be integral with the stage #1 expansion cylinder, the combustion process becomes semi-continuous in that combustion starts when the piston is at the top of the cylinder and continues for a set time as the piston moves down the cylinder a distance, which is in part dependent upon the power requirements of the engine. The intake air valve or fuel ignition assembly valves may be closed at the end of the stroke or any point alone the stroke, depending upon the power requirements of the engine. The oxidant/fuel ratio may also be varied during the stroke, depending upon the power requirements of the engine and/or heat dissipation capacity of the engine from overheating, for instance, as the length of time of combustion increases during a stroke, the amount or ratio of the oxidant/fuel mixture may be adjusted to reduce the intensity of the combustion process. As an example, for start-up or with the combustion of lower grade fuels, a starter fuel may be injected for combustion until the combustion chamber reaches a temperature that would sustain combustion of the lesser grade fuel. Two or more fuels may also be continuously injected at different ratios for mixing with the oxidant during the combustion process of combustion stroke.

As an alternative, as shown in FIG. 5, oxidant and fuel may be injected and atomized in a central mixing chamber prior to injection into the combustion chamber to be combusted and the start of a continuous nearly complete combustion could occur. The combustion chamber may comprise a tubular member with open ends allowing the combustible mixture to be combusted and flow to intake ports of the stage #1 expansion cylinder. Preferably, piping and ports are reduced to maximize the efficiency of the engine. The tubular member may be surrounded by the plenum 86 and oxidant for the combustible mixture may injected from the plenum into the combustion chamber at a rate sufficient to maximize engine performance. Additional oxidant (i.e., bleed air) may be directed to other valves in the engine for cooling thereof. For instance, branches may extend from a central bleed air manifold to channels formed in the valve stems. The branches may also direct bleed air around and adjacent to the valves seats. The plenum would also preheat the oxidant prior to injection and serve to insulate surrounding structures.

Stage #1 Expansion Cylinder

As mentioned previously, the stage #1 expansion cylinder 22 may be integrally formed with the combustion chamber 18 so as to receive the combustion products directly in the combustion process as shown in FIG. 1, or the stage #1 expansion cylinder 22 may be a separate component that receives the combustion products from the combustion chamber 18 through intake ports as shown in FIG. 2. Preferably, the stage #1 expansion cylinder operates at a high temperature and a relatively low pressure, and the materials used in its construction would be suitable for such operating requirements. In each case, the combustion products drive the stage #1 expansion cylinder piston in a reciprocating motion. This reciprocating motion translates to linear reciprocating motion of a central connecting rod, and eventually rotary motion of the engine drive shaft as will be described in further detail below. The linear reciprocating motion of the piston and connecting rod minimizes piston and piston ring seal contact or pressure with the expansion cylinder walls, thus reducing or eliminating oil lubrication requirements in the cylinder. The stage #1 expansion cylinder may also have an over-pressure relief valve.

Stage #2 Expansion Cylinder

Although not essential, the stage #2 expansion cylinder allows the combustion products to be further expanded in a controlled manner to increase the efficiency of the engine. The further expansion of the combustion products in the stage #2 expansion cylinder also enables the combustion chamber and stage #1 expansion cylinder to operate at higher temperatures. The stage #2 expansion cylinder is preferably arranged radially adjacent to the stage #1 expansion cylinder such that the longitudinal axes of the stage #1 and stage #2 expansion cylinders are parallel. The stage #2 expansion cylinder intake valves and ports are preferably aligned to the stage #1 expansion cylinder exhaust valve as applicable, although these structures may be integrated. The stage #2 expansion cylinder may also have an over pressure relief valve.

Pistons and Connecting Rods

The pistons 48,50,56 may be constructed as necessary depending upon whether the cylinder is configured for single action or dual action. For instance, each piston may comprise two round planar pieces of material with integral spacers and a connecting rod connector portion 104 (FIG. 3) disposed therebetween. The pistons may be a high temperature metal, ceramic or composite. The piston, piston rings, and connecting rod may be configured to rotate within the cylinder during operation of the engine. For instance, the connecting rod connector portion 104 (FIG. 3) may comprise a bearing to allow relative rotation of the piston within the cylinder. The connecting rods 52,54,58 may comprise a ratchet system to slightly turn the piston after each stroke thus creating angular variation of the location of wear of the piston, rings and connecting rod with each stroke. Rings for the piston may comprise one or more split rings or segmented rings with gaps sized to maintain proper sealing for a variety of wear conditions, and expansion and contraction during thermal cycling. The rings may comprise a composite of material such as carbon, ceramic, silicon fibers, or high temperature resistant metal, and may include an energizing element, such as a backing spring. The ring material may comprise carbon as it has properties of self lubrication and heat resistance, and water vapor in the combustion products contributes to its lubricity. Each piston may have several rings, for instance, metallic rings for sealing and carbon rings lubricity. It should be appreciated that one or more rings may also be treated with compounds that generate lubricity as they wear. The sides of the spacer/spring may also be configured with slots and/or tabs to center the ring and allow combustion products gas pressure to equalize on each side of the ring. The rings may be provided with a system to detect the wear level of the seal rings in the pistons. For instance, a soft metal bridging across electrodes may be incorporated inside of the seal ring such that once the ring wears to a point the soft material would wear away from the electrodes opening the circuit and setting off a sensor. The connecting rods 52,54,58 may have a tubular construction with internal supports and increased wall thickness at critical connection or stress points. The connecting rod may be cooled as it reciprocates in and out of the expansion cylinders.

Valves

The intake and exhaust valves of the air compressor 106, 108, combustion chamber and stage #1 expansion cylinder 110,112, and stage #2 expansion cylinder 114,116 may be powered hydraulically, electrically or mechanically, or a combination thereof. By way of example, a hydraulic system may comprise a pump, actuators to operate the valves, and cams that port high pressure fluid to the actuators to operate the valves. The cams may be operatively connected to engine output, actuating the valves for the combustion chamber, stage #1 and stage #2 expansion cylinders in a desired sequence or phasing. The cams may be rotatably connected to the engine output via a geared transmission, toothed timing belts, or chains. The valves may also be actuated mechanically via lifters operatively connected to the engine output. In an alternate embodiment, the valves maybe actuated from a high pressure fluid source stored in a reservoir that is kept an elevated pressure via a pump. The high pressure fluid reservoir may comprise a hydraulic fluid accumulator. Sequencing valves may open and close as necessary to direct high pressure fluid to the actuators. The sequencing valves may be computer controlled.

The valve timing for a single acting piston arrangement will be described for illustrative purposes, although it should be appreciated that the sequence will be similar for each side of a dual acting piston arrangement. The stage #1 intake valve 110 opens as the piston 48 moves away from the top of the stage #1 expansion cylinder 22, and stage #1 intake valve 110 closes at a point before or at the time the piston 48 reaches the bottom of the cylinder 22. The stage #1 exhaust valve 112 opens just before or as the piston 48 reverses direction and begins moving toward the top of the cylinder. The stage #1 exhaust valve 112 closes as the piston 48 reaches the top of the cylinder 22. When the engine is provided with a stage #2 expansion cylinder 26, the stage #2 intake valve opens 114 as the piston 50 moves away from the top of the stage #2 cylinder 26, and closes at a point before or at the time the piston reaches the bottom of the cylinder. The stage #2 exhaust valve 116 opens when the stage #2 piston 50 starts moving toward the top of the cylinder 26. The stage #2 exhaust valve 116 closes as the piston 50 reaches the top of the cylinder. The stage #2 intake valve 114 and the stage #1 exhaust valve 112 may be timed to open and close in tandem. The stage #2 intake valve and the stage #1 exhaust valve may also be integrally formed or comprise the same valve body as shown best in FIG. 3. In this arrangement, the stage #1 expansion cylinder exhaust valve 112 preferably opens when the stage #2 expansion cylinder piston starts moving away from the top of the stage #2 expansion cylinder and closes when the stage #2 expansion cylinder piston reaches the bottom of the stage #2 expansion cylinder. As an alternative, for instance, where the engine has a central combustion chamber rather than the arrangement where combustion occurs in the stage #1 expansion cylinder, the intake and exhaust valves opening and closing may slightly overlap to keep the fuel/air flow into the combustion chamber continuous. The stage #2 expansion cylinder exhaust valve or valves preferably open when the piston is at the bottom of the stage #2 expansion cylinder before the stage #2 expansion cylinder piston starts moving back to toward the top.

Exhaust of Combustion Products

After being exhausted from the stage #1 expansion cylinder (or the stage #2 expansion cylinder when so configured), the combustion products may be exhausted directly to atmosphere 118 (FIG. 1) or first to a heat recovery mechanism (i.e., regenerator or radiator) (FIG. 2) to increase efficiency of the engine. In one example, the combustion products may be directed to the regenerator 30 to pre-heat the oxidant from the oxidant source and/or fuel from the fuel source. The regenerator may comprise a first chamber in communication with the oxidant source and a second chamber in communication with the expansion cylinder. The first and second chambers of the regenerator may be configured such that any heat associated the combustion products exhausted from expansion cylinder is transferred to the oxidant before the oxidant enters the combustion chamber. The regenerator first chamber may be integral with the expansion cylinder inlet valve port. The regenerator may have a separate path for preheating fuel as discussed above. The combustion products may also be directed to the radiator 46 to further cool the combustion products and condense any water vapor that may be entrained in the combustion products, either naturally or via injection as described previously. In one embodiment, the radiator 46 is positioned downstream of the regenerator 30 to further cool the combustion products before they are exhausted to atmosphere. One or more valves 118 may be provided in the exhaust system to control heating requirements of the radiator and to direct exhaust to the atmosphere. For instance, a valve may be used to divert some or all the exhaust combustion products directly to the atmosphere from the stage #2 expansion cylinder. It should be appreciated that the radiator may also be used as a heat source, for instance, for heating interior spaces, or preheating fuel or oxidant, in addition to the role described above, namely cooling the combustion products to reduce the exhaust pressure. Preferably, the exhaust combustion products flow from the top of the radiator 46 to the bottom of the radiator with any entrained condensate and the cooler gases settling at the bottom of the radiator. The liquid/gas exhaust pump 36 may be used at the discharge of the radiator 46 to eject combustion products and liquid from the radiator.

Operating the radiator at a reduced backpressure or vacuum may increase engine efficiency. As shown in FIG. 2, the valve 120 between the regenerator 30 and the radiator 46 may be used to release the combustion products directly to atmosphere 118 as may be needed during power transients. Air flow through and around the outside of the radiator may be assisted by an electric or mechanically powered fan 122. The radiator may also be configured as a heat exchanger and cooled by water.

Transmission

FIGS. 3, and 6-11 show various aspects of the transmission assembly 32 used in connection with the engine 10. As best shown in FIG. 3, the transmission comprises a guide system 124,126,128 associated with each piston and expansion cylinder. For instance, in the embodiment where the combustion chamber 18 and stage #1 expansion cylinder 22 are integrally formed, one guide system 124 is associated therewith and a second guide system 126 is associated with the stage #2 expansion cylinder 26. The compressor 14 may also be driven via a guide system 128. Each guide system has a guide frame 130 with a crank head 132 adapted to translate along the guide frame in a reciprocating fashion from one end of the guide frame to a longitudinal opposite end of the guide frame. The guide frame 130 may comprise spaced apart rails adapted to allow the crank head to translate therealong in a linear fashion. The crank head 132 is operatively connected to the connecting rod and the piston associated with the expansion cylinder. The guide frame 130 may have a first drive wheel 134 rotatably mounted at one end of the guide frame and a second drive wheel 136 rotatably mounted at a longitudinal opposite end of the guide frame. The drive wheels may comprise sprockets. Each of the drive wheels 134,136 may be driven by an inextensible continuous loop 138, for instance, a chain or a belt. The crank head 132 preferably has a drive connection 140 pivotally connecting the crank head to the continuous loop. The connection may be integral with a link in a chain. With the guide system crank head operatively connected to the expansion cylinder piston, linear reciprocating motion of the expansion cylinder piston in the expansion cylinder results in corresponding linear reciprocating motion of the guide system crank head along the first guide frame. The drive connection pivotally extending between the continuous loop and the crank head, results in movement of the loop, and corresponding rotation of the drive wheels. The drive wheels of the guide systems may then operatively drive the drive shaft 38 of the engine.

Figure 6:
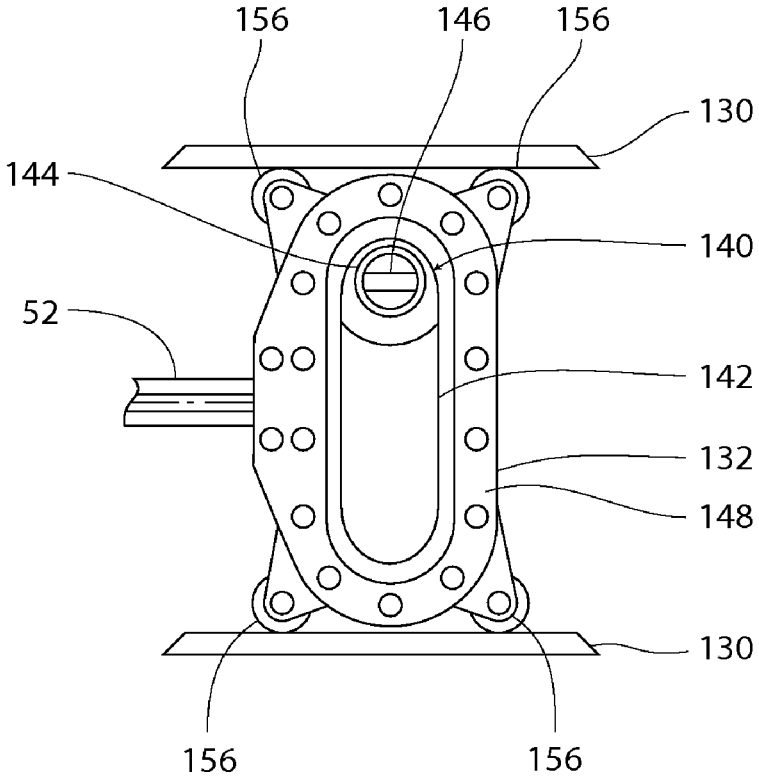
FIG. 6 shows an embodiment of a crank head and portion of a guide frame of a transmission assembly of an embodiment of the heat engine as shown in FIG. 3.
Figure 7:
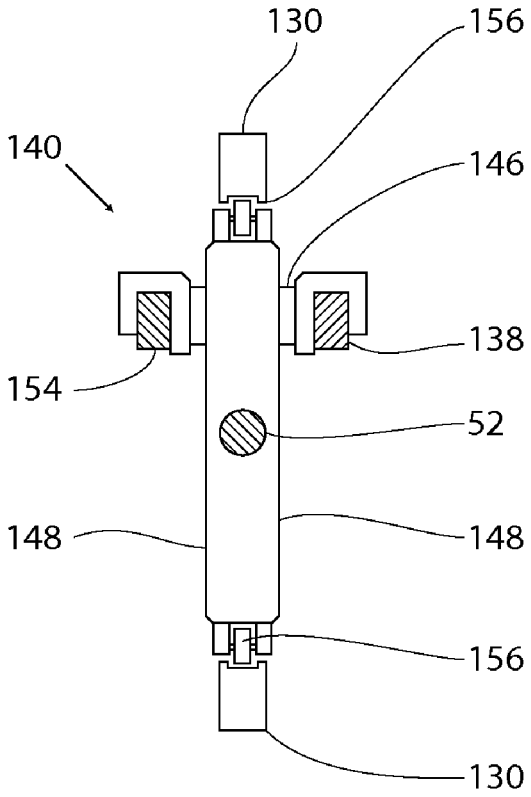
FIG. 7 shows a front sectional view of a crank head and guide frame portion of FIG. 6.

As best shown in FIG. 6, the crank head 132 may be provided with a slot 142 and the drive connection 140 may be moveably disposed therein. The slot 142 may be arranged in a direction generally transverse to the guide frame 130 and to allow translation and pivoting of the drive connection within the slot. The drive connection 140 may comprise a bearing 144 disposed in the slot and a loop mounting device 146 attached to the bearing and the loop. Referring to FIG. 7, the crank head preferably comprises plate members 148 defining a plane generally parallel with the linear reciprocating motion of the crank head along the guide frame and connected to each other in a side-by-side configuration. The crank head may comprise plate members defining a plane generally parallel with the linear reciprocating motion of the crank head along the guide frame and connected to each other in a side-by-side configuration. Additional sets of drive wheels 150,152 and a second continuous loop 154 may flank each side of the guide frame 130 to balance loading on the guide frame. For instance, each guide frame may have another set of drive wheels rotatably mounted at opposite ends of the guide frame on a side opposite the other set of drive wheels and driven by an second inextensible continuous loop. In this arrangement, the drive connection 140 may pivotally connect the crank head 132 to the first and second continuous loops 138,154. Preferably, the crank head is directly connected to the expansion cylinder piston via the connecting rod. The connecting rod may be adjustable along its length to allow timing of the stroke and positioning of a piston in an expansion cylinder. An adjustable link may also be used between the transmission and the cylinder housing. The continuous loops may be tightened by moving the drive wheels apart from one another. The guide frame and crank head work in conjunction to reduce an off centered load from translating into the connecting rod. As shown in FIG. 6, the crank head may have four wheel bearings 156 that rotate in a track of the guide frame. An oil film, magnetic, or air cushion system may be used for the guide to reduce frictional load on the wheel bearings. An oil sump with an oil pump and filter may be provided to lubricate all the key lubrication points with light weight oil. Oil may be placed on the chains on their slack side to ensure lubrication of the chain joints. It may be appreciated that grease may be used in lieu of oil. As an alternative to the slotted bearing type drive connection described above, the drive connection may comprise a short connecting rod having one end pivotally connected to the crank head and the other end pivotally connected to the loop. The transmission system may also comprise a hydraulic pump, spiral, ratchet or rack and pinion drive.

Crank Weights

Figure 8:
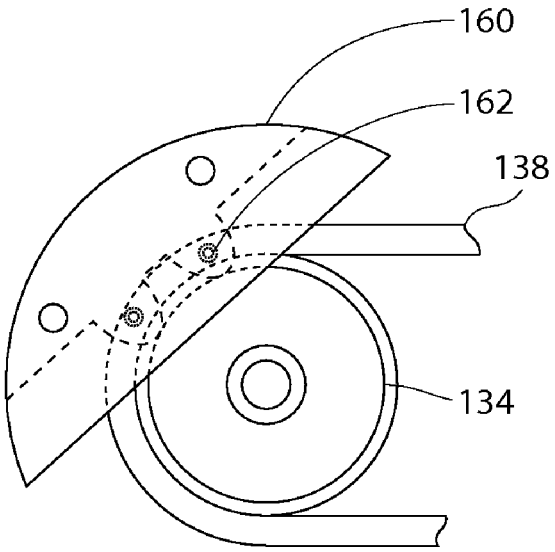
FIG. 8 shows a drive wheel, portion of a continuous loop, and crank weight of the transmission assembly of the heat engine of FIG. 3.

As shown in FIG. 8, a crank weight 160 may be incorporated in the transmission system 32 to offset the end of cycle force from the pistons and connecting rod and to smooth operation of the continuous loops 138, for instance, the chains. One crank weight 160 per loop may be utilized with the weight connected to the loop with a hinged connection 162. The crank weight may be connected to the loop with pivoting connection, for instance, one or more pins. As best shown in FIG. 3, the crank weight 160 has a "u"-shaped cross section with the continuous loops 138, 154 disposed in the center of the cross section thereby minimizing interference of the crank weight with the loop as it rotates over the respective drive wheels 134,136,150,152. The crank weight 160 rotates about the drive wheels as the piston and thus the crank head reverse direction during reciprocating motion. The crank weight may also be provided with a slotted pin and bushing connection to accommodate motion and distance changes as the crank weigh rotates about the drive wheel. The crank weight may distribute weight equally to prevent excessive twisting and pulling of its loop and drive connection. Preferably, the crank weight 160 is mounted on the continuous loop at a position longitudinally opposite of the drive connection and crank head so that as the crank head nears the end of its stroke at one end of the guide frame adjacent one (set of) drive wheel(s), the crank weight is located at the longitudinally opposite end of the guide frame and set to rotate about the other (set of) drive wheel(s). The crank weights may be constructed of laminated metal pieces. Dense metals, such as lead, may be used as crank weight material to reduce their size. The crank weights may also be sized to balance the engine. For instance, as mentioned previously, the stage #1 and the stage #2 expansion cylinder pistons preferably travel in opposite directions, so the crank weight associated with the expansion cylinder may have a weight that equals the difference of the weights of the pistons.

Drive Train Components

Figure 9:
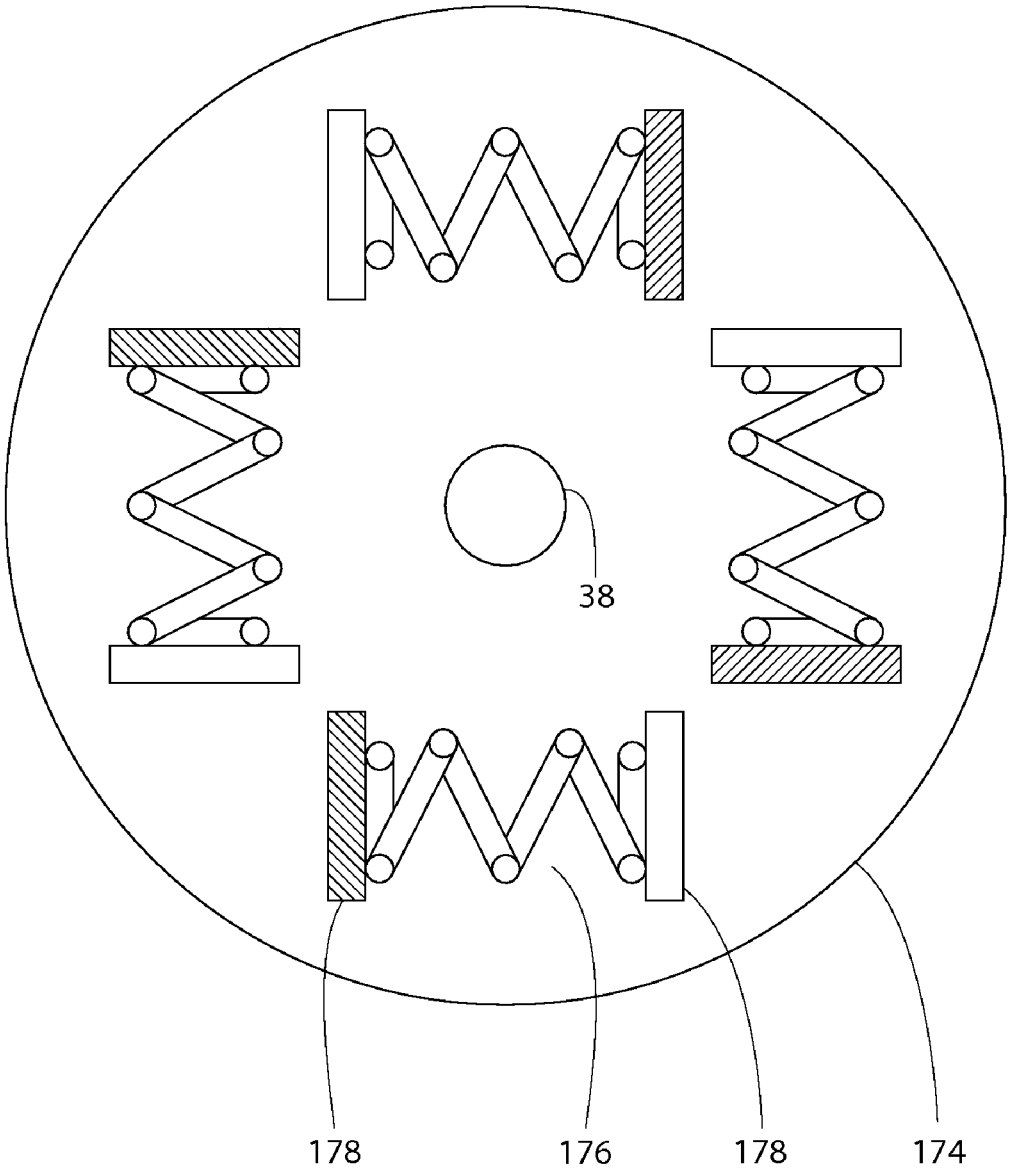
FIG. 9 is a side view of an energy disk used in the transmission system to couple the output of the drive wheels of the transmission assembly to a draft shaft.
Figure 10:
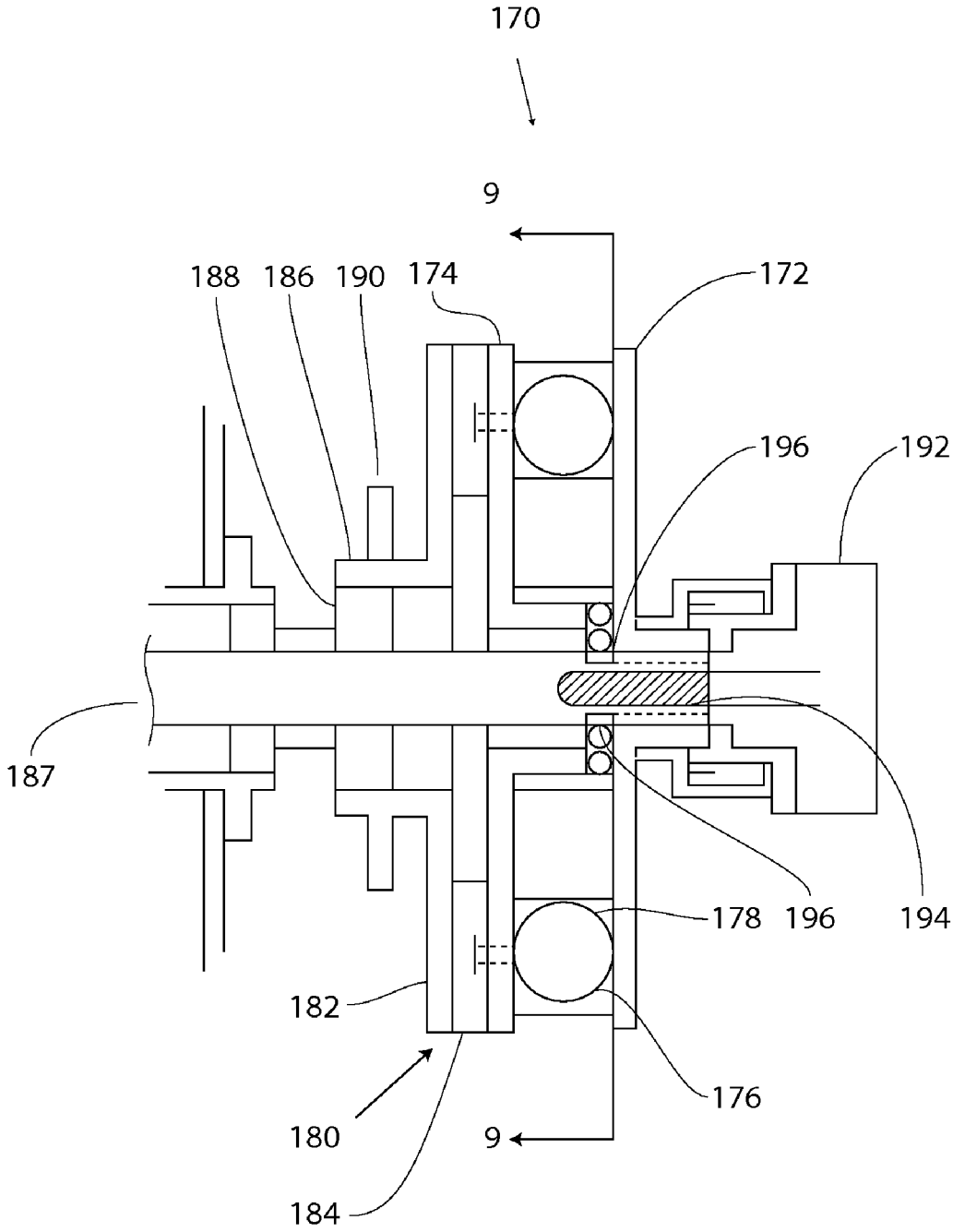
FIG. 10 shows a diagrammatical view of the transmission assembly wherein the energy disk may be clutched into and out of the transmission assembly.

As shown in FIGS. 9 and 10, the engine may also comprise flexible couplings 170 associated with the drive system to absorb changes in speed or energy associated with the engine, especially the starting and stopping of the connecting rods and pistons at the end of each cycle. One type of flexible couple is shown in FIGS. 9 and 10 and comprises two disks 172,174 disposed axially on the drive shaft 38 with coil springs 176 have ends mounted on and thus connecting each of the disks together. The coil springs 176 may be mounted to each disk tangentially to the direction of rotation of the disks at equiangular positions, for instance, the 90 degree positions (positions 1, 2, 3, and 4) of FIG. 9 from a lobe 178 projecting axially from a side of each disk. One of the disks 172 may act as a flywheel and contain additional mass for inertia purposes. Another of the disks 174 may be aligned into and out of the drive chain with a clutch 180. Hydraulic and/or gas filled piston cylinders may be used in lieu of springs.

The clutch 180 may be provided to disengage the drive shaft 38 from the transmission assembly 32 when the engine is to be idled and the power of the engine is not required to drive external equipment. The clutch 180 may comprise a clutch disk 182 that engages clutch pads 184 mounted to the energy disk 174. In FIG. 10, the clutch is shown with the clutch pads 184 engaging the clutch disk 182. In one embodiment of the clutch, the clutch disk 182 has a center hub 186 that rotates about the drive chain output shaft 187 with a bearing set 188 on the inner surface of the hub 186. A sprocket drive gear 190 extends from the hub and may be driven directly via a gear or indirectly via a chain or belt from a (set of) drive wheel(s) associated with the expansion cylinders. Once engaged, the clutch transmits rotation from the drive shaft 38 to the energy disks 172,174 and then to the drive chain output shaft 187. The clutch is preferably actuated via a geared electric motor and a lead screw that draws the energy disk and clutch pads in an axial direction into and away from the clutch disk. A key and slots 196 are provided to allow axial movement of the energy disk along the drive chain output shaft 187. It should be appreciated that the clutch may be actuated hydraulically or via a magnet, and may be controlled manually or by a computer.

Figure 11:
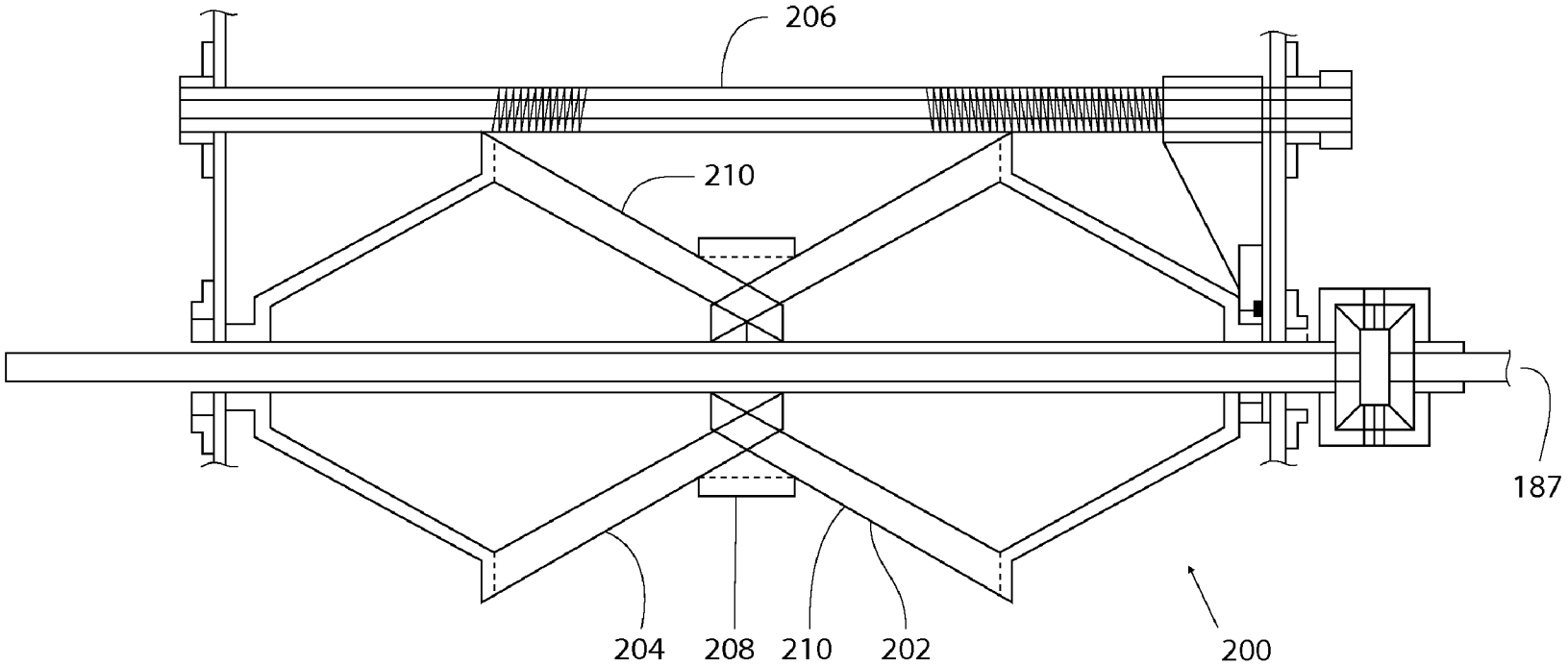
FIG. 11 shows a diagrammatical view of a variable ratio transmission that may be used in the transmission assembly.

The drive chain output shaft 187 may power external equipment through a variable ratio transmission 200 such as that shown in FIG. 11. The variable ratio transmission 200 may be connected directed to the drive chain output, or placed online or offline using the clutch 180. The variable ratio transmission may contain two cone-shaped sprockets 202, 204 that are adjustable via a lead screw 206 driven by an electric motor (not shown) to change the ratio therebetween. A belt 208 may extend between the sprockets to transfer rotation therebetween. The sprockets may have trapezoidal or tapered shaped teeth 210 that engagingly drive the belt 208 between each of the sprockets with the teeth being narrower at a smaller diameter of the sprockets. The belt 208 may be made of flexible material typical in belts, or may comprise a rubber composite material molded to a chain with an inside surface having a profile shaped to engage the teeth of the conical sprockets. Lubrication may be provided for the belt, for instance, through and external sump through which the belt moves or internal channels in the belt (i.e., a self-lubricating belt), and a tensioner may be used to maintain the belt in proper contact with the drive wheels. A portion of the engine output may drive one or more electric motors/generators and/or alternators, for instance, to recharge a battery, start the combustion process, and provide temporary power at start-up for auxiliary equipment of the engine (i.e., air compressor, fuel pump, ignition sparks, etc.). An electric powered motor connected to the engine may provide power to start the combustion process, and provide temporary power at start-up.

CONCLUSION

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An engine comprising:

an oxidant source comprising an oxidant;

a fuel source comprising a fuel;

a combustion chamber having a dual acting piston disposed therein dividing the chamber into sides, the combustion chamber having an inlet port and an outlet port positioned on the combustion chamber relative to one side of the piston and an inlet port and an outlet port positioned on the combustion chamber relative to the opposite side of the piston, the combustion chamber having a fuel ignition assembly comprising (a) an injector adapted to inject the fuel from the fuel source and the oxidant from the oxidant source into the combustion chamber in a manner sufficient to mix the fuel with the oxidant to form a combustible mixture, and (b) an ignition source adapted to ignite the combustible mixture to produce combustion products in the combustion chamber, the fuel ignition assembly sustaining combustion in the combustion chamber for a set continuous period, the inlet and outlet ports being moveable into and out of fluid communication with the fuel ignition assembly in a coordinated fashion on each side of the piston to (a) regulate a flow of the oxidant from the oxidant source into the combustion chamber, (b) sequence the mixing of the fuel with the pressurized air with the ignition of the fuel and pressurized air mixture, and (c) regulate a flow of the combustion products from the combustion chamber, to effect reciprocating motion of the piston in the combustion chamber;

an expansion cylinder having a larger volume than the combustion chamber, the expansion cylinder having a dual acting piston disposed therein dividing the cylinder into sides, the expansion cylinder having an inlet port and an outlet port positioned on the expansion cylinder relative to one side of the piston and an inlet port and an outlet port positioned on the expansion cylinder relative to the opposite side of the expansion cylinder piston, the inlet and outlet ports being moveable into and out of fluid communication in a coordinated fashion with the inlet and outlet ports of the combustion chamber on each side of the expansion cylinder piston to regulate (a) a flow of the combustion products from the combustion chamber to the expansion chamber, and (b) a flow of the combustion products from the expansion cylinder, to effect reciprocating motion of the piston in the expansion cylinder; and a transmission comprising a first guide system associated with the combustion chamber and a second guide system associate with the expansion cylinder, each guide system having a guide frame with a crank head adapted to translate along the guide frame in a reciprocating fashion from one end of the guide frame to a longitudinal opposite end of the guide frame, the guide frame having a first drive wheel rotatably mounted at one end of the guide frame and a second drive wheel rotatably mounted at a longitudinal opposite end of the guide frame, each of the drive wheels being driven by an inextensible continuous loop, the crank head having a drive connection pivotally connecting the crank head to the continuous loop, the first guide system crank head being operatively connected to the combustion chamber piston such that linear reciprocating motion of the combustion chamber piston in the combustion chamber results in corresponding linear reciprocating motion of the first guide system crank head along the first guide frame, movement of the loop, and corresponding rotation of the drive wheels, the second guide system crank head being operatively connected to the expansion cylinder piston such that linear reciprocating motion of the expansion piston in the expansion piston results in linear reciprocating motion of the second guide system crank head along the second guide frame, movement of the loop, and corresponding rotation of the drive wheels, the drive wheels of the first and second guide systems being adapted to operatively drive a drive shaft.

2. The engine of claim 1, wherein the loop comprises a chain.

3. The engine of claim 1, wherein the drive wheels comprise sprockets.

4. The engine of claim 1, wherein the oxidant source comprises air from an air compressor with an intake adapted to draw air from atmosphere and a discharge adapted to discharge pressurized air from the air compressor.

5. The engine of claim 4, wherein the oxidant source further comprises a tank communicating with the air compressor discharge.

6. The engine of claim 1, further comprising a regenerator having a first chamber in communication with the oxidant source and a second chamber in communication with the expansion cylinder, the first and second chambers of the regenerator being configured such that any heat associated the combustion products exhausted from expansion cylinder is transferred to the oxidant before the oxidant enters the combustion chamber.

7. The engine of claim 1, further comprising a radiator through which the combustion products are cooled after exhaustion from the expansion cylinder.

8. The engine of claim 1, wherein the fuel ignition assembly comprises:

an inner valve sleeve comprising a tubular member with an interior communicating with the fuel source to deliver fuel to the combustion chamber, the inner valve sleeve having an inner poppet comprising a valve stem disposed in the inner valve sleeve interior and a valve body connected to the valve stem, the valve body being positionable relative to a distal end of the inner valve sleeve to regulate the flow of fuel into the combustion chamber; and an outer valve sleeve comprising a tube with an inner surface receiving the inner valve sleeve, the outer valve sleeve having outer and inner valve seats on its distal end, the outer valve sleeve being positionable between a first position where the distal end is spaced from the inner valve sleeve and the poppet to allow the oxidant to flow into the combustion chamber and a second position where the outer valve seat cooperates with an intake port in the combustion chamber to seal the combustion chamber from the oxidant source and the inner valve seat cooperates with the inner poppet valve body to seal the inner valve seal interior.

9. The engine of claim 8, wherein the inner poppet valve stem and inner valve sleeve are sufficiently electrically conductive to generate a spark to ignite the combustible mixture when the valve body is spaced from the inner valve sleeve.

10. The engine of claim 1, wherein, the crank head has a slot with the drive connection moveably disposed therein, the slot being arranged in a direction generally transverse to the guide frame and to allow translation and pivoting of the drive connection within the slot.

11. The engine of claim 1, wherein the crank head comprises plate members defining a plane generally parallel with the linear reciprocating motion of the crank head along the guide frame and connected to each other in a side-by-side configuration.

12. The engine of claim 1, further comprising a crank weight mounted to the loop and passing around the drive wheels as the crank head reverses direction during the linear reciprocating motion of the crank head along the guide frame.

13. The engine of claim 1, further comprising a third drive wheel rotatably mounted at one end of the guide frame and a fourth wheel rotatably mounted at a longitudinal opposite end of the guide frame, each of the drive wheels being driven by an second inextensible continuous loop, the third and fourth drive wheels being positioned on one side of the guide frame and the first and second drive wheel being positioned on an opposite side of the guide frame.

14. The engine of claim 13, wherein the drive connection pivotally connects the crank head to the first and second continuous loops.

15. The engine of claim 1, wherein the drive connection comprises a bearing disposed in the slot and a loop mounting device attached to the bearing and the loop.

16. The engine of claim 1, wherein each crank head is directly connected to its respective piston via a connecting rod.

17. The engine of claim 16, wherein at least one of the connecting rod and respective piston rotate about their axes during operation of the engine.

* * * * *